United States Patent [19]

Gaudet

[11] 4,011,531

[45] Mar. 8, 1977

[54] MICROWAVE ATTENUATOR HAVING COMPENSATING INDUCTIVE ELEMENT

[75] Inventor: Herbert C. Gaudet, Ann Arbor, Mich.

[73] Assignee: Midwest Microwave, Inc., Ann Arbor, Mich.

[22] Filed: Sept. 29, 1975

[21] Appl. No.: 617,789

[52] U.S. Cl. ..... 333/81 A; 338/309

[51] Int. Cl.[2] ..... H01P 1/22

[58] Field of Search ..... 333/22 R, 81 R, 81 A; 338/216

[56] References Cited

UNITED STATES PATENTS

| | | | |
|---|---|---|---|
| 3,521,201 | 7/1970 | Veteran | 333/81 R |
| 3,543,197 | 11/1970 | Adam et al. | 333/81 A |

*Primary Examiner*—Paul L. Gensler

*Attorney, Agent, or Firm*—Harness, Dickey & Pierce

[57] ABSTRACT

A microwave attenuator structure including an attenuator card having disposed thereon a pair of resistive elements electrically connected in series by an inductive element for compensating for an otherwise occurring decline in the value of the attenuator at high frequencies, and a method of constructing the subject attenuator.

15 Claims, 5 Drawing Figures

10
12
14
16
18
20
22
24
26
28
30
32
34
36
38
38'
40
42
44
46
48
50
52
54
56
58

MICROWAVE ATTENUATOR HAVING COMPENSATING INDUCTIVE ELEMENT

BACKGROUND AND SUMMARY OF THE INVENTION

Various broadband microwave attenuators are known to the art which contain a single resistive surface which forms both the series attenuated path between the primary conductors and a shunt impedance path between the primary conductors and the ground conductor. The resistive element of such devices is ordinarily deposited on a rectangular plane surface of a ceramic member.

One of the difficulties encountered in the manufacture of these devices is the problem of accurately calibrating attenuators having high db values; (e.g. 40 db or above). To combat this difficulty, recent prior attenuators have two or more separate resistive elements deposited on the same ceramic member which are series connected by a conductor. In this manner, the calibration problem associated with large db attenuators is averted by constructing what is essentially two or more smaller attenuators (the sum of whose db values equals the desired db value) on the same ceramic member and connecting the "sub-attenuators" in series.

Another difficulty encountered with attenuators is an inherent tendency to provide less attenuation at high frequencies. In other words, the db value of the attenuation tends to decline as the frequency of the applied signal increases.

The present invention provides a microwave attenuator having two or more resistive elements disposed on a single ceramic member as described above, with an inductive element connected in series between the two resistive elements to compensate for the tendency of the db value of the attenuator to decline. Since the effect of an inductance increases with frequency, the inductive element effectively compensates for the inherent drop in the db level of the attenuator element with increasing frequency. Thus, the overall db level of the attenuator is maintained at or substantially near its rated value over a wider range of frequencies.

As will subsequently be described in greater detail, the inductance in the attenuator element is created by bridging a narrow gap in the center conductor which provides the electrical series connection between the two resistive elements with a conductive element of substantially reduced width relative to the center conductor between the two resistive elements. As is well known in the microwave art, the substantial change in the width of the center conductor generates an inductance, the value of which is dependent upon its length and its width. By varying these dimensions, a suitable inductance can be created which will properly "correlate" with the inherent decline in db value of the attenuator to offset same.

In view of the above explanation, it will be appreciated that a microwave attenuator is provided which includes an inductive element which effectively compensates for the inherent drop in the db level of the attenuator element which occurs at high frequencies, thereby increasing the effective operating bandwidth of the attenuator.

DETAILED DESCRIPTION OF THE PREFERRED EMBODIMENT

Figures 1, 2, 3, 4, 5:
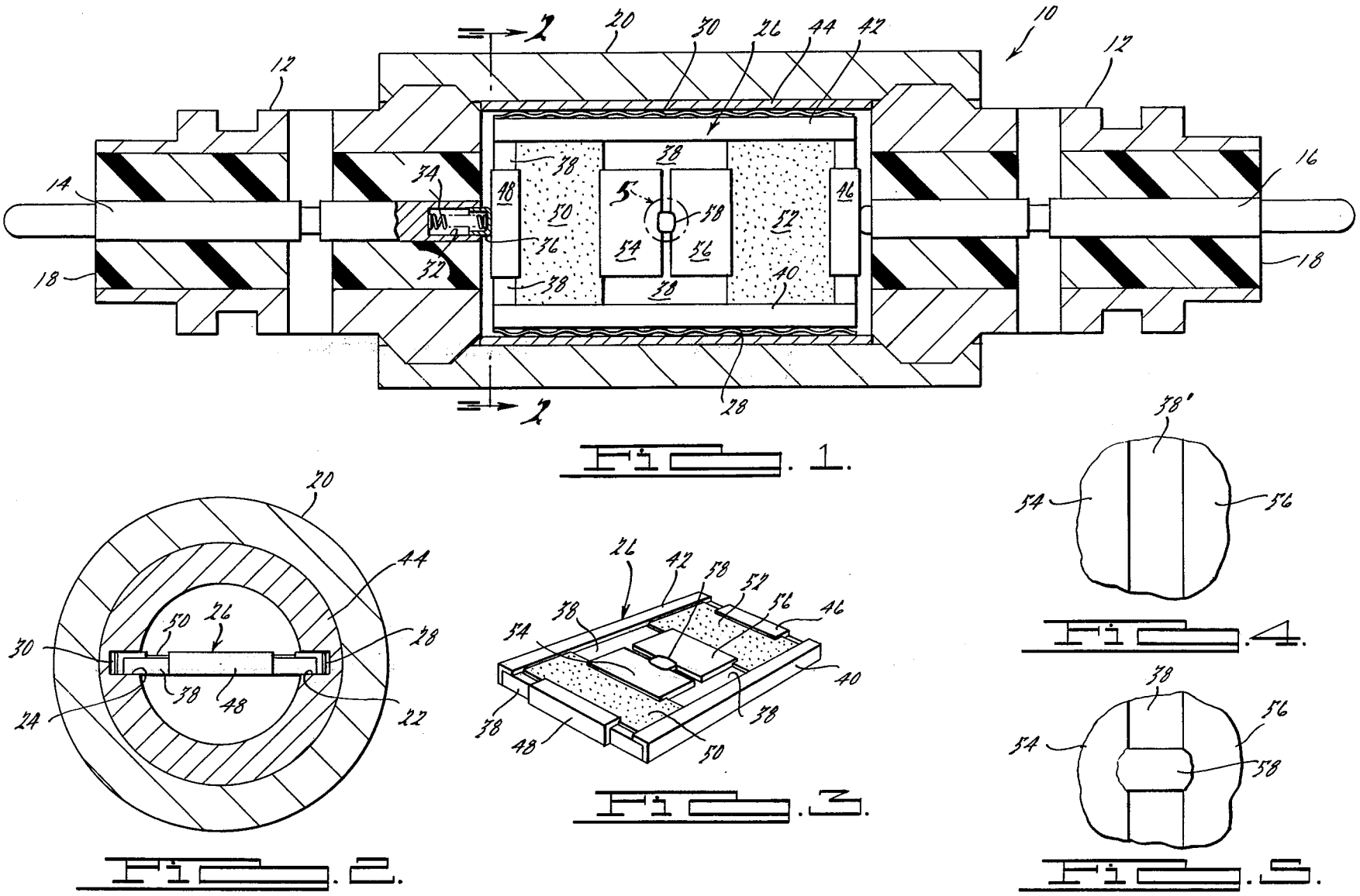
FIG. 1 is a cross-sectional view of an exemplary microwave co-axial attenuator according to this invention.
FIG. 2 is a cross-sectional view of the attenuator of FIG. 1 taken along line 2—2.
FIG. 3 is a perspective view of the attenuator element of the attenuator of FIG. 1.
FIG. 4 is an enlarged view of a portion of the attenuator element indicated in FIG. 1, without the bridge conductor.
FIG. 5 is an enlarged view of the same portion of the attenuator element illustrated in FIG. 4 showing the bridge conductor.

Referring to FIG. 1, an exemplary microwave attenuator 10 as taught by the present invention is shown. The attenuator 10 illustrated in FIG. 1 is designed to be connected to a co-axial structure. However, as will be readily apparent to those skilled in the microwave art, the present invention is also readily adaptable to a strip-line application. The attenuator 10 consists of an outer or ground conductor 12, a pair of co-axial center conductors 14 and 16, and an attenuator element 26. The center conductors 14 and 16 are supported within the outer conductor 12 by means of a dielectric element 18. The support member 18 is constructed of a suitable dielectric material such as Teflon. The outer conductor 12 is substantially tubular shaped with its end segments adapted to be connected to the outer conductor of an external co-axial cable (not shown). The ground conductor member in the central part of the attenuator 10 consists of a housing 20 also having a tubular shape. Housing member 20 is larger in diameter than the remainder of attenuator 10 to accommodate the attenuator element 26 as will be subsequently described. Closely fitting with the inner wall of housing 20 is a tubular shaped cartridge member 44. Cartridge 44 is shorter in length than housing 20 and has an outer diameter substantially equivalent to the inner diameter of housing 20.

As can best be seen in FIG. 2, cartridge 44 contains a pair of radially opposed slots 22 and 24, which extend along the entire axial length of the cartridge 44. Attenuator element 26 is adapted to be slidably mounted and electrically engaged with slots 22 and 24 as shown.

Looking to FIG. 3, a perspective view of attenuator element 26 is illustrated. The height dimensions of attenuator element 26 depicted in FIGS. 2 and 3 are greatly exaggerated for illustrative purposes only. Attenuator element or "card" 26 is rectangular shaped and consists of a dielectric substrate 38 which may be constructed of a ceramic material such as beryllium oxide or aluminum oxide. Beryllium oxide is preferred because of its excellent thermal conductivity which allows heat generated by the dissipated microwave power in the attenuator element 26 to be efficiently transferred to the ground conductor 12. Attenuator card 26 has a length substantially equivalent to the axial length of cartridge 44 and a width substantially equivalent to the radial distance between slots 22 and 24 in cartridge 44.

Deposited on the planar surface of card 26 are two resistive elements 50 and 52. Resistive elements 50 and 52 each consist of a substantially rectangular shaped layer of carbon film which extends across the width of card 26.

Deposited on the side surfaces 40 and 42 along the length of card 26, and also on portions of the end surfaces 46 and 48 along the width of card 26, is a layer of highly-conductive gold paint. Note that the gold paint overlaps onto the adjacent longitudinal edges of the planar surface of card 26 so as to make electrical contact with resistive layers 50 and 52. Specifically, resistive layer 50 is in electrical contact with side conductors 40 and 42 and end conductor 48, and resistive layer 52 is in electrical contact with side conductors 40 and 42 and end conductor 46. Thus as can be seen, resistive layer 50 provides a shunt resistive path between conductor 48 and conductors 40 and 42, and resistive layer 52 provides a shunt resistive path between conductor 46 and conductors 40 and 42.

Typically on cards having more than one resistive layer deposited thereon, the resistive layers are merely connected in series by a conductive strip of gold paint. The disadvantage of constructing a card in this manner is that it ignores the problem of the decline in the db value of the attenuator which occurs at high frequencies. This problem is particularly conspicuous in attenuators having a high db rated value. The result is a limited operating bandwidth which in turn restricts the attenuator's applications.

To counteract this phenomenon, the present invention provides an inductive element connected in series between the two resistive layers. It is common electronic knowledge that the impedance effect of an inductance in a series circuit increases proportionately with frequency. Thus, it appears that the characteristics of a series inductance are directly opposite to the phenomenon previously described. By connecting the proper inductance in series with resistive layers 50 and 52 on attenuator element 26, the overall db level of the attenuator 10 can be maintained at or near its rated value over a wider range of frequencies. And in fact, the result is a high db microwave attenuator having an effective bandwidth of up to 18 GHz.

Returning to FIG. 3, the inductive member of attenuator element 26 consists of gold painted conductors 54 and 56 and bridge member 58. As can be seen from the drawing, conductor 54 is in electrical contact with resistive layer 50 and conductor 56 is in electrical contact with resistive layer 52. Note, however, that conductors 54 and 56 are not in electrical contact with one another, but instead define a narrow gap 38', as indicated in FIG. 4. The gap 38' between conductors 54 and 56 is bridged by a small conductive member 58, as shown in FIG. 5. As is best illustrated in FIGS. 1 and 3, the width of bridge member 58 is substantially smaller than the width of conductors 54 and 56. The substantial reduction in the width of bridge element 58 creates an inductance at microwave frequencies in the series resistive path — as defined by end conductors 46 and 48, resistive layers 50 and 52, conductors 54 and 56, and bridge member 58 — of attenuator element 26. The value of the inductance generated is dependent upon the length and width of bridge member 58. Depending on the rated db value of the attenuator 10, the bridge member will typically vary from 0.020 to 0.070 inches in length, and have a width dimension of from 20–70% that of conductors 54 and 56. The exact dimensions are arrived at by approximating the value of inductance needed and then testing to determine if the value of inductance must be increased or decreased to provide the proper compensation. Once the dimensions for a given attenuator model have been established, the same dimensions can be satisfactorily used for all attenuators of that model.

Returning to FIG. 1, attenuator 26 is installed within cartridge 44 by inserting card 26 into slots 22 and 24 as shown in FIG. 2. To insure that a proper electrical connection is made between conductive strips 40 and 42 of card 26 and the inside wall of slots 22 and 24 in cartridge 44, a pair of longitudinal "wavy" springs 28 and 30 are inserted in slots 22 and 24 between card 26 and cartridge 44. Springs 28 and 30 provide a pressure contact between conductors 40 and 42 and cartridge 44, which in turn is electrically connected to ground conductor 12.

To insure a proper electrical connection between center conductors 14 and 16 and conductive strips 48 and 46, respectively, center conductors 14 and 16 have formed therein a center bore 32, as illustrated in FIG. 1. Inserted within this center bore 32 is a spring 34 and plunger 36 assembly which provides a pressure contact between conductive strips 46 and 48 and center conductors 14 and 16 respectively. Note that spring 34 and plunger 36 assembly are also gold plated to additionally insure a positive electrical connection between center conductors 14 and 16 and attenuator element 26. Thus, for example, center conductor 16 will transmit an attenuated portion of the microwave energy received by center conductor 14 and vice versa.

To construct a microwave attenuator element 26 according to the present invention, the following method is employed. The entire ceramic member 38 is initially fired with a pyrolytic carbon film. The surface areas 52 and 54 on card 26 where the carbon film is desired, are then masked and the remaining carbon film is removed with an abrasive spray. Once the carbon film has been removed from all undesired areas of the card 26, a highly conductive gold paint is then applied to the edges and side surfaces of card 26 as illustrated in FIG. 3. Additionally, the center conductive strips 54 and 56 are painted on using a mask to insure that the proper gap between the two conductive strips is created. At this point, card 26 is connected to one or more meters to measure the series and shunt resistive values of each carbon area 50 and 52. Typically, for example, the desired series resistive value may represent a 40 db signal loss and the shunt impedance may represent a characteristic impedance $Z_o$ of 50 ohms. Each of the two carbon areas 50 and 52 are adjusted until the desired values are attained. Note, however, that the series resistive values of the two carbon areas 50 and 52 do not necessarily have to comprise precisely one-half the overall db rated value of the attenuator card 26. The sum of their series resistive values, of course, must equal the desired db rating of the attenuator. Finally, the inductive bridge 58 is added to card 26.

In view of the above description, it can be seen that the present invention provides a co-axial microwave attenuator which is easily manufactured, is readily adaptable to strip-line application, and provides a wide operating bandwidth over a variety of db values.

While it will be apparent that the teachings herein are well calculated to teach one skilled in the art the method of making the preferred embodiment of this invention, it will be appreciated that the invention is susceptible to modification, variation and change without departing from the proper scope of meaning of the subjoined claims.

What is claimed is:

1. A microwave attenuator comprising:

a pair of first conductors, one being adapted to receive microwave energy and the other being adapted to transmit an attenuated portion of said microwave energy received at said one conductor;

a ground conductor associated with said first conductors of establishing a microwave transmission path therebetween; and an attenuator element including a dielectric member having disposed thereon at least two resistive members, one electrically connected in series to said one conductor and in shunt to said ground conductor and another electrically connected in series to said other of said first pair of conductors and in shunt to said ground conductor, said attenuator element further including a first center conductor intermediate portion having a predetermined transverse width disposed on said dielectric member between said two resistive members and connected in series to said one resistive member, a second center conductor intermediate portion having a predetermined transverse width disposed on said dielectric member between said two resistive members and connected in series to said another resistive member whereby series connection of the entirety of said transverse width of said center conductor intermediate portions would provide a db value of said microwave attenuator which would tend to decline in value as frequency increases, said center conductor intermediate portions being spaced apart so as to define a gap therebetween, and at least one inductive member disposed on said dielectric member and bridging said gap between said first and second center conductors intermediate portions for providing a series electrical connection therebetween, said at least one inductive member having predetermined dimensions including a transverse width which is substantially less than said transverse widths of said center conductor intermediate portions to provide a value of inductance which compensates for the tendency of the db value of said microwave attenuator to decline as frequency increases so that the overall db value of said attenuator element remains substantially constant over a wide range of microwave frequencies.

2. The microwave attenuator according to claim 1 wherein said inductive member has a predetermined length dimension.

3. The microwave attenuator according to claim 1 wherein said inductive member consists of a gold paint.

4. A microwave attenuator element comprising:

a dielectric substrate;

a pair of first conductors disposed on said substrate, one being adapted to receive microwave energy and the other being adapted to transmit an attenuated portion of said microwave energy received at said one conductor;

a pair of ground conductors disposed on said substrate and associated with said first pair of conductors for establishing a microwave transmission path therebetween;

at least two resistive members disposed on said substrate such that one of said resistive members is electrically connected in series to said one conductor and in shunt to said pair of ground conductors, and another is electrically connected in series to the other of said first pair of conductors and in shunt to said pair of ground conductors; and a first center conductor intermediate portion having a predetermined transverse width disposed on said substrate between said two resistive members and connected in series to said one resistive member;

a second center conductor intermediate portion having a predetermined transverse width disposed on said substrate between said two resistive members and connected in series to said another resistive member whereby series connection of the entirety of said transverse width of said center conductor intermediate portions would provide a db value of said microwave attenuator which would tend to decline in value as frequency increases, said center conductor intermediate portions being spaced apart so as to define a gap therebetween;

at least one inductive member disposed on said substrate and bridging said gap between said first and second center conductor intermediate portions for providing a series electrical path therebetween, said at least one inductive member having predetermined dimensions including a transverse width which is substantially less than said transverse widths of said center conductor intermediate portions to provide a value of inductance which compensates for the tendency of the db value of said microwave attenuator to decline as frequency increases so that the overall db value of said attenuator element remains substantially constant over a wide range of microwave frequencies.

5. The microwave attenuator according to claim 4 wherein said inductive member has a predetermined length dimension.

6. The microwave attenuator according to claim 4 wherein said first pair of conductors, said ground conductors, and said inductive member consist of a gold paint.

7. The microwave attenuator according to claim 4 wherein said resistive members consist of a carbon film.

8. A co-axial microwave attenuator comprising:

a pair of first conductors disposed on an axis, one being adapted to receive microwave energy and the other adapted for transmitting an attenuated portion of said microwave energy received at said one conductor;

a ground conductor associated with said first conductors for establishing a microwave transmission path therebetween;

an attenuator element disposed along said axis between said pair of first conductors and including a dielectric member having disposed thereon at least two resistive members, one electrically connected in series to said one conductor and in shunt to said ground conductor and another electrically connected in series to said other of said first pair of conductors and in shunt to said ground conductor, a first center conductor intermediate portion having a predetermined transverse width disposed on said dielectric member between said two resistive members and connected in series to said one resistive member, a second center conductor intermediate portion having a predetermined transverse width disposed on said dielectric member between said two resistive members and connected in series to said another resistive member whereby series connection of the entirety of said transverse width of said center conductor intermediate portions would provide a db value of said microwave attenuator which would tend to decline in value as frequency increases, said center conductor intermediate portions being spaced apart so as to define a gap therebetween, and at least one inductive member disposed on said dielectric member and bridging said gap between said first and second center conductor intermediate portions for providing a series electrical connection therebetween, said at least one inductive member having predetermined dimensions including a transverse width which is substantially less than said transverse widths of said center conductor intermediate portions to provide a value of inductance which compensates for the tendency of the db value of said microwave attenuator to decline as frequency increases so that the overall db value of said attenuator element remains substantially constant over a wide range of microwave frequencies.

9. The co-axial microwave attenuator according to claim 8 wherein said ground conductor consists of a substantially tubular shaped member axially aligned with said first pair of conductors.

10. The microwave attenuator according to claim 8 wherein said inductive member has a predetermined length dimension.

11. The microwave attenuator according to claim 10 wherein said inductive member consists of a gold paint.

12. A microwave attenuator adapted to be connected in a co-axial structure having an inner conductor and an outer conductor comprising:

a substantially tubular shaped ground conductor disposed along the axis of said co-axial structure and adapted to be connected to said outer conductor;

a pair of center conductors axially aligned within said ground conductor, one being adapted to be connected to said inner conductor for receiving microwave energy, and the other adapted to be connected to said inner conductor for transmitting an attenuated portion of said microwave energy received at said one conductor;

a substantially rectangular shaped attenuator element disposed within said ground conductor between said pair of center conductors and comprising a dielectric substrate having disposed thereon at least two planar resistive members, one being electrically connected in series to said one of said center conductors and in shunt to said ground conductor and another being electrically connected in series to said other of said pair of center conductors and in shunt to said ground conductor, a first center conductor intermediate portion having a predetermined transverse width disposed on said dielectric member between said two resistive members and connected in series to said one resistive member, a second center conductor intermediate portion having a predetermined transverse width disposed on said dielectric member between said two resistive members and connected in series to said another resistive member whereby series connection of the entirety of said transverse width of said center conductor intermediate portions would provide a db value of said microwave attenuator which would tend to decline in value as frequency increases, said center conductor intermediate portions being spaced apart so as to define a gap therebetween, and at least one inductive member disposed on said dielectric substrate and bridging said gap between said first and second center conductors intermediate portions for providing a series electrical connection therebetween, said at least one inductive member having predetermined dimensions including a transverse width which is substantially less than said transverse widths of said center conductor intermediate portions to provide a value of inductance which compensates for the tendency of the db value of said microwave attenuator to decline as frequency increases so that the overall db value of said attenuator element remains substantially constant over a wide range of microwave frequencies.

13. The microwave attenuator according to claim 12 wherein said inductive member has a predetermined length dimension.

14. The microwave attenuator according to claim 12 wherein said inductive member consists of a gold paint.

15. The method of constructing a microwave attenuator element consisting of:

applying at least two areas of resistive material to a dielectric substrate;

applying a first conductor intermediate portion intermediate said areas of resistive material having a predetermined transverse width and connected in series with one of said areas of resistive material and applying a second conductor intermediate portion intermediate said areas of resistive material having a predetermined transverse width and connected in series with the other of said areas of resistive material so that said first and second conductor intermediate portions are spaced apart and define a gap therebetween whereby series connection of the entirety of said transverse width of said first and second conductor intermediate portions would provide a db value of said microwave attenuator which would tend to decline in value as frequency increases;

adjusting the resistive values of said areas so that said resistive values are approximate desired values;

electrically connecting said first and second conductor intermediate portions in series with a conductor having predetermined dimensions including a transverse width which is substantially less than said transverse widths of said conductor intermediate portions to provide a value of inductance at the operating frequency of said microwave attenuator element which compensates for the tendency of the db value of said microwave attenuator to decline as frequency increases so that the overall db value of attenuator element remains substantially constant over a wide range of microwave frequencies.

* * * * *